US008295538B2

(12) United States Patent
Harris et al.

(10) Patent No.: US 8,295,538 B2
(45) Date of Patent: Oct. 23, 2012

(54) LOUDSPEAKER SPIDER

(75) Inventors: Michael Harris, Cardiff (GB); Jon Nicholls, Cardiff (GB)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1033 days.

(21) Appl. No.: 12/197,214

(22) Filed: Aug. 22, 2008

(65) Prior Publication Data

US 2010/0046788 A1 Feb. 25, 2010

(51) Int. Cl.
*H04R 1/00* (2006.01)

(52) U.S. Cl. ..... 381/404; 264/104

(58) Field of Classification Search ..... 381/381; 264/104

See application file for complete search history.

(56) References Cited

U.S. PATENT DOCUMENTS

| | | | | |
|---|---|---|---|---|
| 5,008,945 | A | 4/1991 | Murayama et al. | |
| 5,822,444 | A | 10/1998 | Oizumi et al. | |
| 6,332,262 | B1 | 12/2001 | Sakamoto | |
| 6,853,734 | B2 | 2/2005 | Sahyoun | |
| 6,863,152 | B1 | 3/2005 | Sahyoun | |
| 7,013,017 | B2 * | 3/2006 | Pavlovic | 381/369 |
| 2004/0001603 | A1 | 1/2004 | Sahyoun | |
| 2004/0008860 | A1 | 1/2004 | Wu | |
| 2006/0159300 | A1 | 7/2006 | Ohara | |
| 2007/0071274 | A1 | 3/2007 | Andersen et al. | |

FOREIGN PATENT DOCUMENTS

| | | |
|---|---|---|
| EP | 1793648 | 6/2007 |

* cited by examiner

*Primary Examiner* — Alexander Ghyka
*Assistant Examiner* — Stanetta Isaac
(74) *Attorney, Agent, or Firm* — O'Shea Getz P.C.

(57) ABSTRACT

A loudspeaker spider comprises rubber type material having a central opening defining an inner rim, a periphery outer rim, and a spring effect portion provided at a portion located between the inner rim and the outer rim to enable the inner rim to be moved axially up and down with respect to the outer rim when a driving force is applied to the inner rim and be retained to an original equilibrium position after the driving force is released. The spider also includes an integral conductor arrangement which comprises at least one conductor where at least a portion of the at least one conductor extends from the inner rim to the outer rim of the loudspeaker spider.

30 Claims, 5 Drawing Sheets

LOUDSPEAKER SPIDER

FIELD OF THE INVENTION

This invention relates to loudspeakers and in particular to an improvement in the spiders of moving coil loudspeakers. More specifically, aspects of the invention relate to a novel loudspeaker spider material and loudspeaker construction, and to electrically connecting the moving voice coil to the fixed loudspeaker terminals.

RELATED ART

Conventional moving coil loudspeakers comprise a frame, a loudspeaker drive system, a diaphragm, and a suspension system. The loudspeaker drive system is fixed to the frame and includes for example, a permanent magnet, a pole piece, front and back plates, an air gap, and a voice coil. The voice coil is fixed to an inner edge of the diaphragm and arranged such that it is movable in the air gap in an axial up and down direction. The suspension system is required to restore the driving force that the voice coil and the permanent magnet produce and conventionally comprises an annular spider linking the outer edge of the voice coil to the frame, and a surround component as edge support linking an outer edge of the diaphragm to the frame. The spider is responsible for guiding the motion of the diaphragm in the axial up and down direction. The surround is conventionally made from foam, rubber or cloth since a low mechanical resistance in each direction is desired with high damping properties, while the spider is usually made from woven fabric which is treated with a phenolic resin to stiffen the spider and provide the desired restoring forces required in the axial up and down direction.

Conventional loudspeakers also comprise a pair of lead wires that connect the voice coil with a loudspeaker terminal mounted on the frame. However, several problems may be induced from the flying wires connection between the voice coil and the loudspeaker terminal. To overcome some of these difficulties, several proposals have been made to incorporate into the suspension system of such loudspeakers the wires for connecting the voice coil to the loudspeaker terminal. One approach is a spider where a braid is woven into the fabric. However, the manufacturing of such spiders is labor intensive, highly variable, and, thus, very costly. Furthermore, since the woven fabric is treated with chemicals and pressed, the quality of the electrical connection may deteriorate. Also, the process is time consuming to set-up the loom, add the phenolic resin, et cetera, and exhibits a health and safety issue because the solutions used to apply the phenolic resin are highly flammable and carcinogenic. In view of the above, there is a need for an improved loudspeaker spider and an improved method for manufacturing such spiders.

SUMMARY OF THE INVENTION

A loudspeaker spider arrangement includes a loudspeaker spider comprising rubber or rubber-like material. The spider has a central opening defining an inner rim, a periphery outer rim, and a spring effect portion provided at a portion located between the inner rim and the outer rim to enable the inner rim to be moved axially up and down with respect to the outer rim when a driving force is applied to the inner rim and be retained to an original equilibrium position after the driving force is released. An integral conductor arrangement comprises at least one conductor where at least a portion of the at least one conductor extends from the inner rim to the outer rim of the loudspeaker spider.

Another aspect of the invention relates to manufacturing such a loudspeaker spider arrangement. The method comprises providing one or more insert molds, the one or more insert molds being shaped for molding a loudspeaker spider arrangement. At least one conductor is positioned so that the at least one conductor or part of it is positioned in at least one insert mold. The mold is closed and molding in each of the insert molds using rubber or rubber-like material is performed.

DESCRIPTION OF THE DRAWINGS

These and other objects, features, and advantages of the present invention will become apparent in light of the drawings and detailed description of the present invention provided below. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
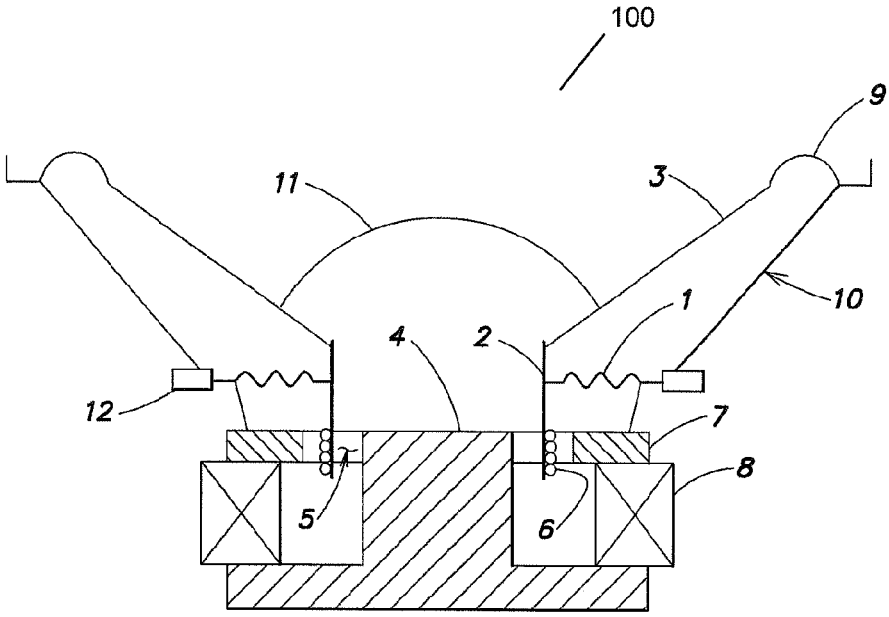
FIG. 1 is a sectional view of a loudspeaker comprising a spider.

FIG. 1 illustrates a moving coil loudspeaker 100 comprising a metallic pole piece 4, which comprises a metallic back plate with a cylindrical metallic pole that is centrally attached. A ring permanent magnet 8 is fixed onto the pole piece 4 at the periphery to surround the pole piece 4 with a space. The ring-shaped front plate 7 surrounds the top of the pole piece 4 and thus forms a magnetic air gap 5 between the top of the pole piece 4 and the front plate 7. A voice coil carrier 2 carrying at least one voice coil 6 is freely inserted to the magnetic air gap 5 and is supported outside by a spider 1 that is fixed to a frame 10. The voice coil carrier 2 is also connected (e.g., rigidly) to the center of a cone-shaped diaphragm 3. At its center, the diaphragm 3 is attached to a dust cap 11. The opening periphery of the diaphragm 3 is supported by a surround 9 which is fixed to the frame 10. An electromagnetic effect caused by an electric current passing through the voice coil 6 vibrates the voice coil carrier 2 to drive the diaphragm 3. The current is supplied by an external source (not shown) to a terminal block 12 from which it is transferred to the voice coil 6 by the spider 1 comprising integrated conductors (not shown in FIG. 1).

Figure 2:
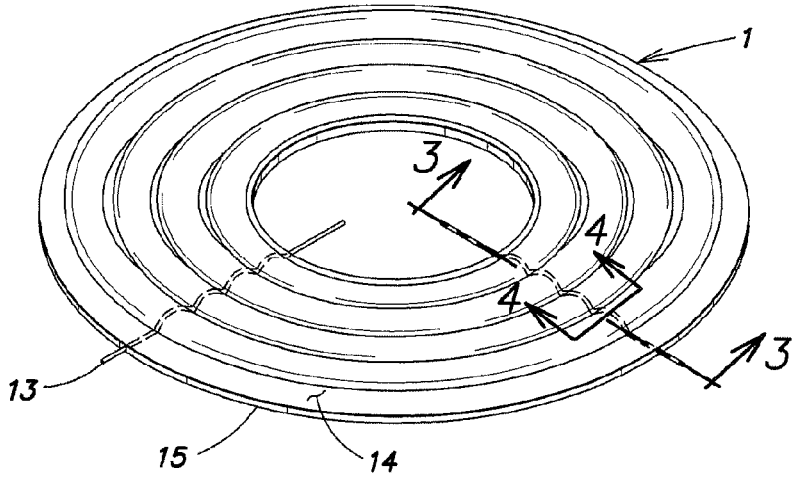
FIG. 2 is a schematic diagram of a spider with integrated conductors.
Figure 3:
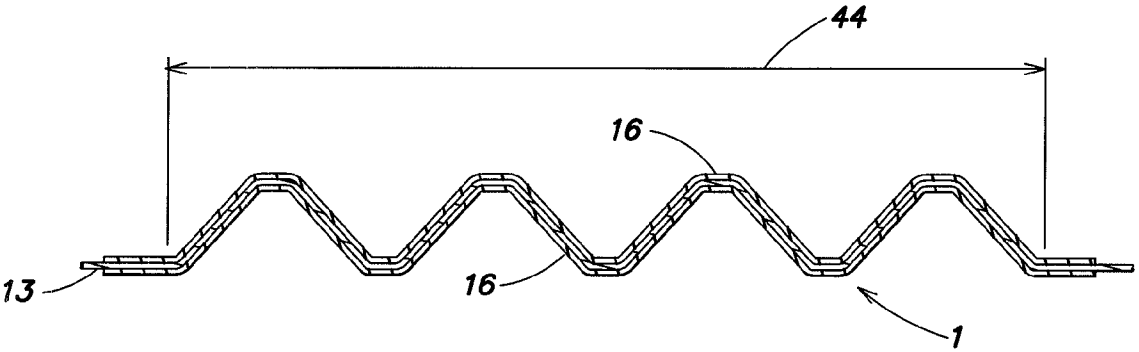
FIG. 3 is a sectional view of the spider taken along line B-B of FIG. 2.

FIG. 2 illustrates an embodiment of the loudspeaker spider 1 with integrated conductors. As also shown in the sectional view of the spider structure of FIG. 3, taken along line B-B of FIG. 2, at least one conductor (e.g., two lead wires 13) is embedded in an electrically insulating, elastic material 16 that forms the annular spider 1 having two surfaces 14, 15 as well as an inner rim and an outer rim. The at least one lead wire 13 is arranged radially, only having its two ends exposed outside the inner rim and outer rim. In order to form a spring effect portion 44 extending somewhere between the inner rim and the outer rim, the spider 1 comprises corrugations that may have a sinusoidal cross section. Alternatively, triangle-shaped, semicircular, or flat cross sections may be used. Further, the spring effect portion may comprise, alternatively or additionally, thickness variations or varying materials.

Figure 4:
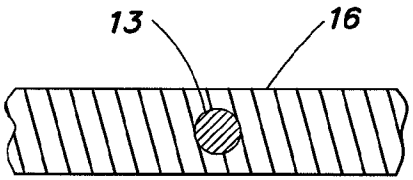
FIG. 4 is an enlarged sectional view of the spider taken along line A-A of FIG. 2.

The electrically insulating, elastic material 16 may be a rubber or a rubber-like material that may also partly comprise fibrous material such as, but not limited to Nomex, Polyester, Teflon, glass fiber, carbon fiber, Kapton, Nylon, Aramids or eucalyptus. The elastic material 16 may partly or totally surround the lead wire 13 as illustrated in the sectional view of the spider structure of FIG. 4, taken along line A-A of FIG. 2. Instead of wires having an annular cross-section, wires having different cross-sections, conductive tinsel strands formed into twisted cords, braided and litz wires, or foil conductors may be used as well to provide a flexible conductive path required between the voice coil and the loudspeaker terminals. Flexible foil conductors may be formed from very thin conductive foil comprising aluminum, copper, copper alloy, or silver plated copper alloy. Multiple strands provide the total conductivity needed to reduce heating of the conductive assembly due to power dissipation in the assembly. Braiding or litz configuration of the multiple strands further improves the flex life of the conductive assembly by increasing the flexibility of the conductive foil per unit length of the conductive cord.

Figure 6:
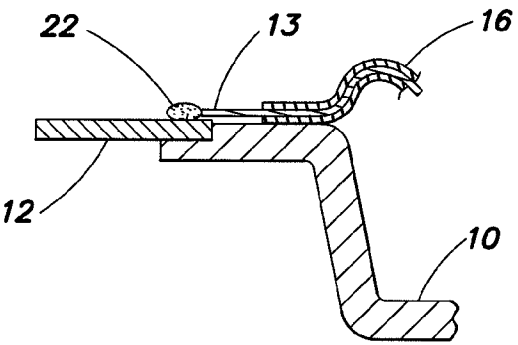
FIG. 6 is an enlarged sectional view of a terminal section of a loudspeaker connected to a foil conductor of a spider.
Figure 5:
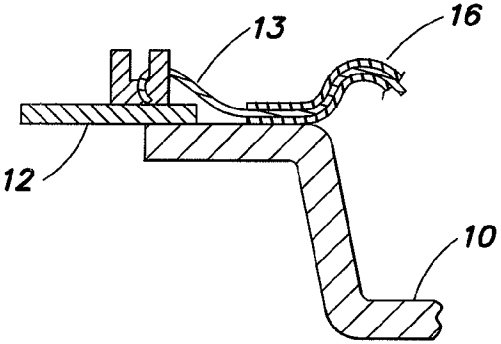
FIG. 5 is an enlarged sectional view of a terminal section of a loudspeaker connected to a wire conductor of a spider.

As shown in the enlarged diagrams of FIGS. 5 and 6, the at least one lead wire 13 extends outwardly from the outer radial edge of the spider 1 to be connected to the terminals 12 provided on the loudspeaker frame 10. For example, the lead wires 13 may be connected to the terminal 12 by soldering, crimping, induction soldering techniques or the like. In the example of FIG. 5, the lead wire 13 is crimped at the terminal 12. In the example of FIG. 6, a conductive foil 13 is used which is electrically and mechanically connected to the terminal 12 by a solder ball 22. In this case, the terminal may be, for example, a tinned metal terminal or the like. Instead of solder, conductive adhesive may also be used.

Figure 7:
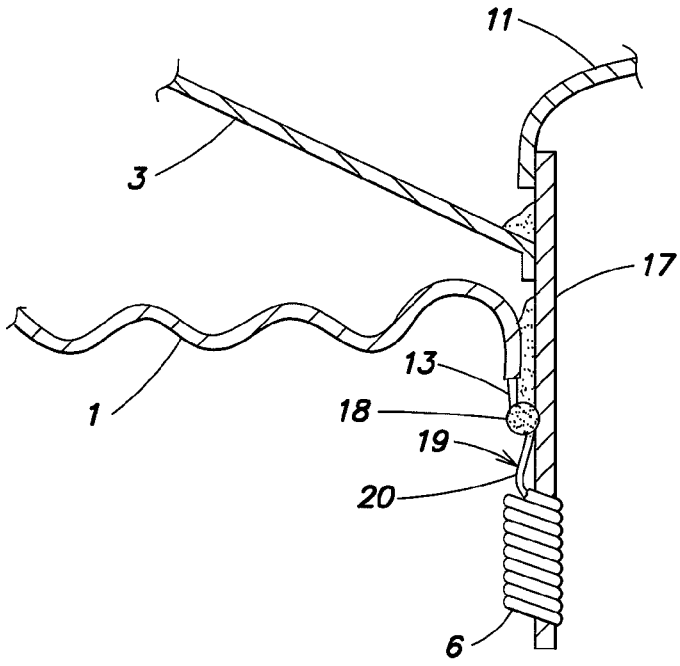
FIG. 7 is an enlarged sectional view of the voice coil section of a loudspeaker comprising a spider.

FIG. 7 shows the cross section of the spider 1 at the inner end portion of the integral conductor, the at least one of the lead wires 13, and one end 20 of the voice coil wire 19. The at least one lead wire 13 extends outwardly from the inner radial edge of the spider 1 to be connected to the voice coil 6, which has been wound around a carrier 17 at a position such that it will be located in the air gap 5 when the loudspeaker is assembled. The ends 20 of the voice coil wire 19 are in electrical contact with the lead wires 13 integrated in the spider 1 where, for example, conductive adhesive or a solder ball interconnects the flexible conductor provided by the lead wires 13 of the spider 1 to the stripped area of the voice coil wire 19 provided by the ends 20. Alternatively, the voice coil 6 may comprise solder pads, which are arranged above the spider 1 between the spider 1 and the diaphragm 3 or even above the spider 1 and the diaphragm.

As the lead wires 13 are an integral component of the spider 1, they are coated with rubber or rubber-like material through the manufacture process and, thus electrically insulated. Accordingly, no further electrical insulation of the lead wires is necessary. To be able to solder the lead wires 13, they may be coated at their ends with wax prior to molding. This wax will be dissipated in the high temperature molding process, leaving the lead wires ready for interconnection. In the manufacturing process, the lead wires are clamped in a molding tool and the spider is then molded by injecting liquid rubber or rubber-like material into the heated tool or by placing the rubber or rubber-like material in a compression molding tool or any other molding process. Due to the shape of the molding tool concentric convolutions at the spring effect portion of the spider 1 are formed.

As illustrated in FIG. 7, to form the interconnection between the voice coil wire and the lead wires 13 incorporated in the spider 1, the voice coil wire is stripped of insulation and adhesive in the ends 20, using conventional techniques, where it lies adjacent to the spider 1. A small droplet 18 of conductive adhesive is applied to each voice coil's end 20. Another option is to use voice coils with solder pads on so the spider integrated wire can be directly soldered to a copper or tinned pad.

After the conductive adhesive is applied to the ends 20 of the wires 19, the spider 1 is positioned with the lead wires over the conductive adhesive 18. The conductive adhesive 18 forms a small conductive fillet between the voice coil wires 19 and the flexible lead wires 13 in the spider 1. A second, electrically non-conductive adhesive (not shown) may be applied around the entire junction of the spider 1 and voice coil carrier 17 to join the spider 1 to the voice coil carrier 17. This adhesive can be applied right over, and cured at the same temperature and time required to cure the conductive adhesive. A similar process may be used for the solder pad option. The non-conductive adhesive has substantially no effect on the proximity, placement, or cure of the conductive adhesive. The diaphragm 3 and the dust cap 11 may be fixed to the voice coil carrier 17 in a similar manner using non-conductive adhesive. After the adhesives are applied, they are cured, thus completing an electrically conductive spider/voice coil assembly. Alternatively, the conductive adhesive or the solder paste may be cured prior to applying the non-conductive adhesive to fix the voice coil to the spider. The spider/voice coil assembly is then mounted into the loudspeaker using techniques such as, for example, non-conductive adhesives, with care being taken to prevent the lead wires 13 from being shorted to the frame 10.

The use of the conductive adhesive eliminates problems related to the common practice of soldering this joint. The conductive adhesive provides an effective structural joint with the components it joins. The conductive adhesive also readily bridges and joins to the lead wires 13. Conductive adhesive also eliminates the flux contamination typical with conventional soldering techniques.

A soldering process may be as follows: the voice coil and spider are assembled together so that the integrated wires within the spider line up with the solder pads on the voice coil. Solder paste is applied to this joint and an induction head is used to reflow the solder paste creating an electrical connection. An adhesive is used to mechanically join the voice coil spider together, which encapsulates the solder joint.

When looking at the force versus deflection profile and comparing rubber spiders to a conventional spider made from cloth with impregnated phenolic resin there are some differences. One difference is that for some rubber materials the stiffness varies significantly and can be highly nonlinear and as a result the stiffness varies over the full excursion range from small deflections to large deflections for typical geometries. Such a characteristic is not desired and as a result the typical structures and/or geometries of a conventional cloth spider may not work when being used for a rubber spider. To overcome the problems outlined above, fibers such as, for example, Nomex, Polyester, Teflon, glass fiber, Kapton, Nylon, Aramids or eucalyptus to the rubber or rubber-like material may be added to enhance the mechanical properties of the spider.

Figure 8:
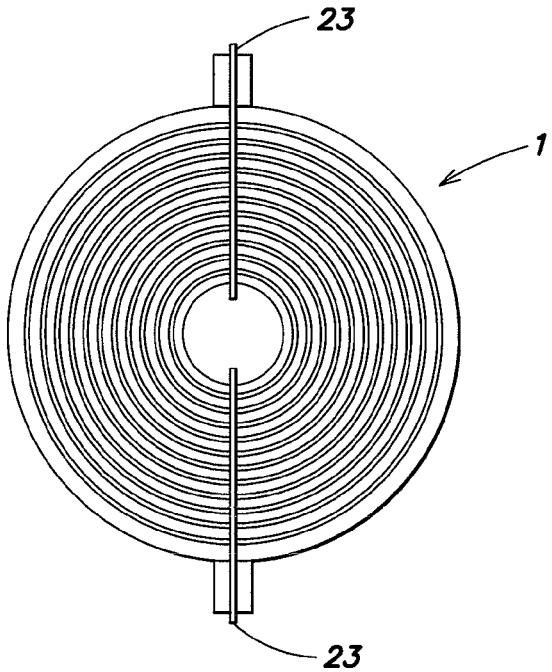
FIG. 8 is a schematic diagram of a novel spider comprising two braided wires incorporated.
Figure 9:
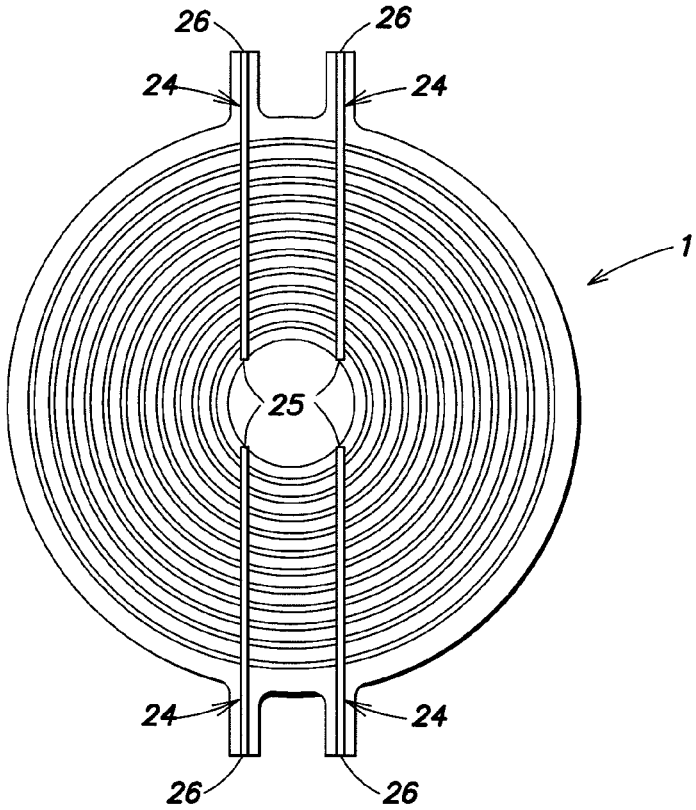
FIG. 9 is a schematic diagram of a novel spider comprising four conductors incorporated.
Figure 10:
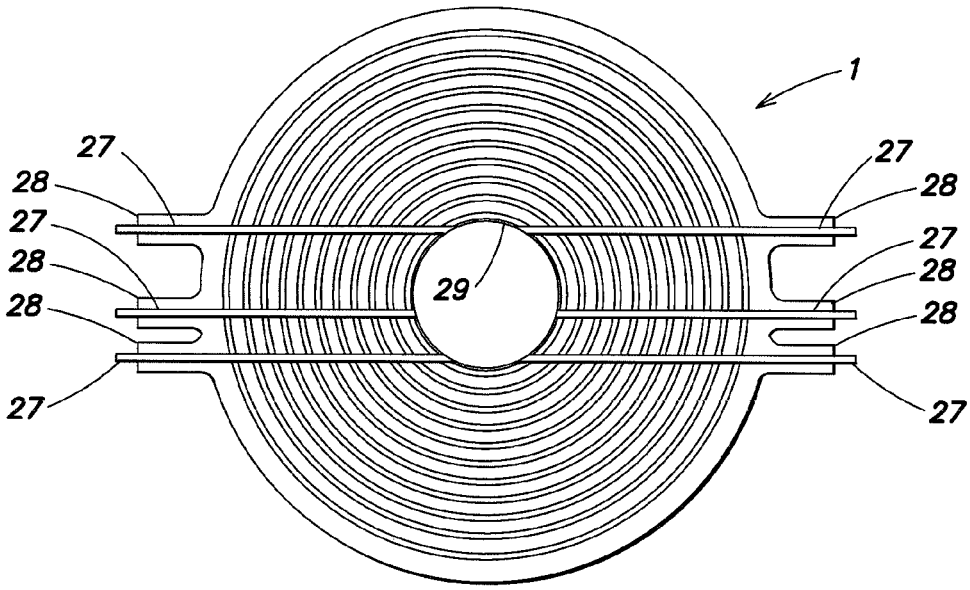
FIG. 10 is a schematic diagram of a novel spider comprising six double litz conductors incorporated.
Figure 11:
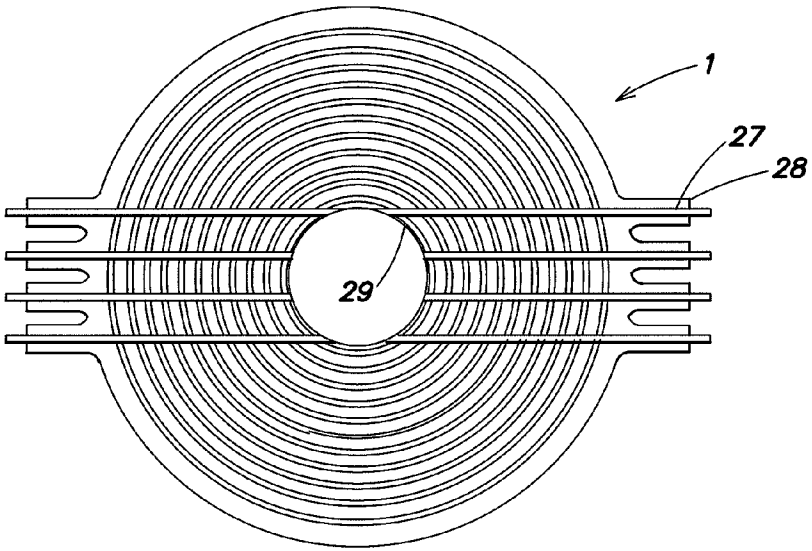
FIG. 11 is a schematic diagram of a spider comprising eight double litz conductors incorporated.

FIGS. 8-11 illustrate different conductor structures—for example wire structures or foil structures—having different numbers of conductors being incorporated in the spider 1. FIG. 8 is a schematic diagram of a two conductor structure incorporated in a spider where the two conductors are braided wires 23 arranged in an angle of 180° to each other. FIG. 9 is a schematic diagram of a four conductor structure where pairs of conductors 24 are arranged parallel and equally spaced either side of the centre position along one of the axis where each pair having two conductors arranged in an angle of 180° to each other. The spider 1 of FIG. 10 comprises support structures 28, 29 for the inner end portion 25 and the outer end portions 26 of the conductors 24 where end portions 26 may extend outwardly from the outer rim supported by a structure 28 and end portions 25 may extend outwardly from the inner rim supported by a structure 29. FIGS. 10 and 11 show spiders 1 having three pairs, or four pairs of conductors, respectively, where each conductor is a double litz wire 27.

The conductors that are used within the molded rubber spiders need to be able to carry the required current to power the loudspeaker to the specified power level without burning out and becoming open circuit. The wire conductors that are suitable are litz wires, braided wires, woven wires and other wires that are flexible and can move in all of the x, y and z directions easily without resistance that limits normal voice coil movement within the magnetic air gap. These wires also have a large enough size to be capable of withstanding the temperatures required to carry the required current within the loudspeaker. If the temperature of the wires becomes too high then this will affect the molded rubber or rubber-like material causing it to age, become brittle, fracture or break, resulting in a spider component that does not operate to its desired specification. Due to the material that is being used within the spider a temperature limit of the braid has initially been set at about 120° C. This temperature value is set so that it is low enough away from the materials melting temperature, but this temperature may be increased depending on the specific circumstances. If the temperature of a single wire, braid or litz wire, reaches this temperature limit then a different wire or additional wires will be required to spread the current and temperature across multiple wires. The number of strands within the litz or braided wires may be increased as only a single wire will be placed within the molding tool prior to the rubber or rubber-like material being added either by injection molding or compression molding techniques or any other applicable techniques. The wire conductor can be held in place within the mold either by clips, springs, or a vacuum. However, one of ordinary skill will recognize that additional methods to hold the wire conductors may also be used.

The rubber or rubber-like material is a very complex material that has many different materials blended together. Rubber materials or rubber-like materials are, for example, vulcanized rubbers such as natural rubber, reclaimed rubber, synthetic rubber, alone or in combination, as well as thermoplastic rubber and elastomers. These rubber materials are more specifically SBR (Styrene-butadiene), Butyl, high temperature SBR, Neoprene, Ethylene propylene, Silicons, Nitrile, Norsorex, Norborene and other materials that are blends of these. These different materials require careful engineering design and development to control the principle attribute of the spiders function within a loudspeaker. Such design and development criteria are, for example, the spider geometry, material, thickness, damping and hardness to ensure that the restoring force is as desired to obtain desirable acoustic performance. There is also the issue that a conductor is placed within the rubber or rubber-like material. Careful consideration is required in the choice of conductor to enable the spider to move freely when the spider moves.

The heating effect that the conductor has on the rubber or rubber-like material is also an important aspect as already outlined above. As the conductor gets hot this will age the rubber or rubber-like material causing it to become hard and brittle if the incorrect rubber or rubber-like material or the incorrect conductor material and shape is chosen. For example, synthetic rubber materials and compounds may be used that are not affected when in contact with other materials that get hot. To reduce the heating effects from the conductor an adequate number of wires may be chosen to ensure the wires do not get hot but are capable of carrying the required current.

Figure 12:
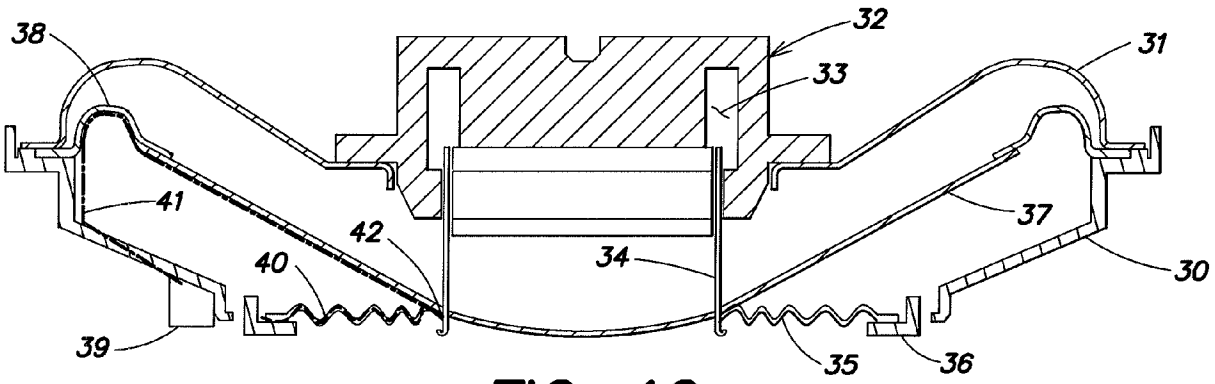
FIG. 12 is a sectional view of a loudspeaker with an inverted motor design comprising a novel spider.

FIG. 12 is a sectional view of a flat loudspeaker having an inverted magnet loudspeaker design. The loudspeaker comprises a frame 30, for example a plastic or metal basket, covered on the front side by a cone-shaped cradle 31 which carries in its center an inwardly opening cup-shaped pole piece 32 to which it is attached. The pole piece 32 is formed with an annular recess 33 for accommodating one edge of a voice coil system 34. The voice coil system 34 comprises a voice coil supported on a carrier, for example an axial slit cylindrical aluminum sheet (not shown in detail).

The loudspeaker further comprises a spider 35 that resiliently supports the outer edge of the voice coil system 34. The spider 35 is attached on its inner end to the voice coil system 34 and on its outer end to a spider carrier 36. The spider carrier 36 is bonded to the rear portion of the frame 30. A cone-shaped diaphragm 37 is attached in its center to the voice coil system 34 and in its outer circumference via a rubber surround 38 to the front portion of the basket 30.

In the loudspeaker of FIG. 12, one current path 40 passes through the spider 35 and another current path 41 through the diaphragm 37, the surround 38 and the frame 30 from a terminal 39 to connection pads 42 of the voice coil system 34. The diaphragm 37 may be made of aluminum, paper, plastics, or composites thereof. The diaphragm 37 may, in particular, be made from Meta-Aramids such as Nomex and Conex, where the conductor is woven within this material during the manufacturing of the cloth. The cloth is then impregnated with a Phenolic resin and the cone is thermally set and molded into the desired shape to form a cone. Par-Aramids such as Kevlar and other materials such as Technora, Twarron or Xian may also be used. These woven materials are heat resistant and are well suited for such application where a wire conductor is placed in close proximity to the woven material, as high current carrying conductors can be used without effecting, distorting damaging or discoloring the woven materials.

Polypropylene materials (including for example Polyvinyl Chloride, Polyethylene, Nylon, Polystyrene, Polyethylene Terephthalate, Polyamide, Polyester, Polycarbonate and ABS, etc.) may also be used. A current carrying conductor may be deposited upon the surface of such materials or etched if the diaphragm is coated with an electrically conductive layer, e.g., copper or the like. The technique of etching or depositing this conductor is the same that is used with printed circuit boards (PCB). The conductor may also be in the form of a copper strip that meets the intended current carrying capacity and intended power requirements. The copper strip conductor may be glued to the diaphragm's surface.

In case of an aluminum diaphragm, the diaphragm itself may form the conductor which may be electrically insulated by a coating or layer of insulating material, e.g., plastics, lacquer such as Polyvinyl Chloride, oxide and many others.

Other materials that may also be considered are paper, which the conductor is either glued upon the paper surface or a double pulp forming process is used whereby the paper diaphragm is formed and partially dried before the conductor, braid, litz or copper strip is placed on top of the cone-formed diaphragm before a second cone forming is carried out to embed the conductor between the two layers of formed paper pulp. If the conductor is long enough connections may be made at the inside and periphery of the cone for electrical connection to the voice coil and surround components.

Another approach is to have a conductor be inserted between a closed cell foam material and the coating material that is used to strengthen the composite cone structure. For example, the closed cell foam material can be thermally formed. Another material such as the Nomex and Conex Meta-Aramids or the Technora, Twarron or Xian Par-Aramids along with carbon fiber and glass fiber may also be adhered to the closed cell foam each side or just on one of the sides to increase the structure stiffness. The conductor can be inserted between one of these skins or woven within one of the skins to provide the electrical connection between the voice coil system and a connector terminal prior to thermally forming the composite foam and woven material structure to the desired form or geometry.

Although examples of the present invention have been described herein above in detail, it is desired, to emphasize that this has been for the purpose of illustrating the present invention and should not be considered as necessarily limitative of the invention, it being understood that many modifications and variations can be made by those skilled in the art while still practicing the invention claimed herein.

What is claimed is:

1. A loudspeaker spider, comprising:

rubber type material having a central opening defining an inner rim, a periphery outer rim, and a spring effect portion provided at a portion located between the inner rim and the outer rim to enable the inner rim to be moved axially up and down with respect to the outer rim when a driving force is applied to the inner rim and be retained to an original equilibrium position after the driving force is released; and an integral conductor arrangement which comprises at least one conductor, where at least a portion of the at least one conductor extends from the inner rim to the outer rim of the loudspeaker spider.

2. The loudspeaker spider of claim 1, where the at least one conductor has a length longer than a distance between the inner rim and the outer rim of the loudspeaker spider and where an inner end portion and an outer end portion of the conductor are outwardly extended from the inner rim and the outer rim of the loudspeaker spider, respectively.

3. The loudspeaker spider of claim 1, where the rubber type material comprises at least one of natural rubber, reclaimed rubber, synthetic rubber, thermoplastic rubber, and elastomers.

4. The loudspeaker spider of claim 3, where the rubber type material comprises at least one of Styrene-butadiene (SBR), Butyl, high temperature Styrene-butadiene (SBR), Neoprene, Ethylene propylene, Silicon, Nitrile, Norsorex, and Norborene.

5. The loudspeaker spider of claim 1, where the rubber type material comprises fibrous material.

6. The loudspeaker spider of claim 5, where the fibrous material comprises one of Nomex, Polyester, Teflon, glass fiber, carbon fiber, Kapton, Nylon, Aramids, and eucalyptus.

7. The loudspeaker spider of claim 6, where the conductor is relatively flexible.

8. The loudspeaker spider of claim 7, where the conductor is one of litz wire, braided wire, and woven wire.

9. The loudspeaker spider of claim 1, where the conductor comprises a foil conductor.

10. The loudspeaker spider of claim 9, comprising at least two conductors.

11. The loudspeaker spider of claim 1, where the at least a portion of the at least one conductor is at least partially embedded in the rubber type material.

12. The loudspeaker spider of claim 11, where the at least a portion of the at least one conductor extends through the rubber type material from the inner rim to the outer rim.

13. A loudspeaker comprising:

a frame;

a terminal;

a loudspeaker drive system;

a diaphragm;

a suspension comprising a loudspeaker spider comprising rubber type material which has a central opening defining an inner rim, a periphery outer rim, and a spring effect portion provided at a portion located between the inner rim and the outer rim to enable the inner rim to be moved axially up and down with respect to the outer rim when a driving force is applied to the inner rim and be retained to an original equilibrium position after the driving force is released; and an integral conductor arrangement which comprises at least one conductor, where at least a portion of the at least one conductor extends from the inner rim to the outer rim of the loudspeaker spider.

14. The loudspeaker of claim 13, where the at least one conductor has a length longer than a distance between the inner rim and the outer rim of the loudspeaker spider and where an inner end portion and an outer end portion of the conductor are outwardly extended from the inner rim and the outer rim of the loudspeaker spider, respectively.

15. The loudspeaker of claim 13, where the rubber type material comprises at least one of natural rubber, reclaimed rubber, synthetic rubber, thermoplastic rubber, and elastomers.

16. The loudspeaker of claim 15, where the rubber or rubber-like material comprises at least one of Styrene-butadiene (SBR), Butyl, high temperature Styrene-butadiene (SBR), Neoprene, Ethylene propylene, Silicon, Nitrile, Norsorex, and Norborene.

17. The loudspeaker of claim 13, where the rubber type material comprises fibrous material.

18. The loudspeaker of claim 17, where the fibrous material comprises one of Nomex, Polyester, Teflon, glass fiber, Kapton, Nylon, Aramids, and eucalyptus.

19. The loudspeaker of claim 13, where the conductor is relatively flexible.

20. The loudspeaker of claim 19, where the conductor is one of litz wire, braided wire, and woven wire.

21. The loudspeaker of claim 13, where the conductor comprises a foil conductor.

22. The loudspeaker of claim 21, comprising at least two conductors.

23. The loudspeaker of claim 22, where the conductor is electrically connected to the loudspeaker drive system by solder or electrically conductive adhesive.

24. The loudspeaker of claim 23, where the conductor is electrically connected to the loudspeaker terminal by solder, electrically conductive adhesive, or a crimp connection.

25. The loudspeaker of claim 24, where the a loudspeaker drive system comprises a voice coil connected to a conductor integrated in the loudspeaker spider or a conductor integrated in the diaphragm.

26. The loudspeaker of claim 25, where the conductor integrated in the diaphragm is connected to a further terminal via a conductor integrated in the suspension.

27. The loudspeaker of claim 13, where the at least a portion of the at least one conductor is at least partially embedded in the rubber type material.

28. The loudspeaker of claim 13, where the at least a portion of the at least one conductor extends through the rubber type material from the inner rim to the outer rim.

29. A loudspeaker spider, comprising:

an annular body of elastic material comprising a spring effect portion connected between a radial inner rim and a radial outer rim, where the spring effect portion enables the inner rim to move axially with respect to the outer rim when a driving force is applied to the inner rim and to reestablish an equilibrium position after the driving force is released; and a conductor comprising an integral spider portion connected between two end portions, where the spider portion is embedded in the elastic material and extends between the inner rim and the outer rim.

30. A loudspeaker, comprising:

a frame with an electrical terminal connected thereto;

a loudspeaker drive system comprising a voice coil and a voice coil carrier;

a body of elastic material comprising a spring effect portion connected between the frame and the voice coil carrier, where the spring effect portion enables the voice coil to move axially relative to the frame when a driving force is applied to the voice coil by the loudspeaker drive system and to reestablish an equilibrium position after the driving force is released; and a conductor comprising an integral spider portion connected between a first end portion that is connected to the electrical terminal and a second end portion that is connected to the voice coil, where the spider portion is embedded in and extends through the elastic material.

* * * * *